US008985218B2

(12) United States Patent
Bedouet et al.

(10) Patent No.: US 8,985,218 B2
(45) Date of Patent: Mar. 24, 2015

(54) FORMATION TESTING

(75) Inventors: Sylvain Bedouet, Houston, TX (US); Erik Quam, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 390 days.

(21) Appl. No.: 13/500,422

(22) PCT Filed: Sep. 9, 2010

(86) PCT No.: PCT/US2010/048271
§ 371 (c)(1), (2), (4) Date: Jul. 25, 2012

(87) PCT Pub. No.: WO2011/043890
PCT Pub. Date: Apr. 14, 2011

(65) Prior Publication Data
US 2012/0279702 A1 Nov. 8, 2012

Related U.S. Application Data

(60) Provisional application No. 61/248,721, filed on Oct. 5, 2009.

(51) Int. Cl.
*E21B 43/14* (2006.01)
*E21B 49/08* (2006.01)
*E21B 33/124* (2006.01)

(52) U.S. Cl.
CPC ..... *E21B 49/08* (2013.01); *E21B 33/1243* (2013.01)
USPC ..... 166/336; 166/264; 175/50

(58) Field of Classification Search
CPC ..... E21B 43/14; E21B 47/00
USPC ..... 166/336, 264; 175/50
See application file for complete search history.

(56) References Cited

U.S. PATENT DOCUMENTS

| | | | |
|---|---|---|---|
| 4,547,691 | A | 10/1985 | Valdois et al. |
| 4,860,581 | A | 8/1989 | Zimmerman et al. |
| 5,394,345 | A | 2/1995 | Berard et al. |
| 6,092,416 | A | 7/2000 | Halford et al. |
| 6,354,371 | B1 | 3/2002 | O'Blanc |
| 6,575,243 | B2 | 6/2003 | Pabst |

(Continued)

FOREIGN PATENT DOCUMENTS

WO 2008100156 A1 8/2008

OTHER PUBLICATIONS

Dong, C. et al, "New Downhole-Fluid-Analysis Tool for Improved Reservoir Characterization", SPE 108566, Dec. 2008, pp. 1107-1116.

(Continued)

*Primary Examiner* — William P Neuder
(74) *Attorney, Agent, or Firm* — Kenneth L. Kincaid

(57) ABSTRACT

An example downhole tool configured for conveyance in a wellbore extending into a subterranean formation comprises a first fluid communicator configured to allow drilling fluid communication with an annulus between the downhole tool and the wellbore, a second fluid communicator configured to direct formation fluid to the annulus, and a formation testing device disposed deeper in the wellbore relative to the first fluid communicator and configured to pump formation fluid from the formation to the second fluid communicator. At least one of the first and second fluid communicators comprises a jet pump.

19 Claims, 3 Drawing Sheets

(56) References Cited

U.S. PATENT DOCUMENTS

| | | | | |
|---|---|---|---|---|
| 6,799,469 | B2 | 10/2004 | Demia et al. | |
| 7,183,778 | B2 | 2/2007 | Homan et al. | |
| 7,367,394 | B2 | 5/2008 | Villareal et al. | |
| 7,379,180 | B2 | 5/2008 | Vannuffelen et al. | |
| 7,705,982 | B2 | 4/2010 | Triana et al. | |
| 7,874,199 | B2 | 1/2011 | Chaudoreille et al. | |
| 7,934,547 | B2 | 5/2011 | Milkovisch et al. | |
| 8,015,869 | B2 | 9/2011 | Nold, III et al. | |
| 2008/0302529 | A1* | 12/2008 | Fowler et al. | 166/250.01 |
| 2009/0301716 | A1* | 12/2009 | Johnson | 166/264 |

OTHER PUBLICATIONS

Siswantoro, M. P. et al, "The Application of Modular Formation Dynamics Tester-MDT* with a Dual Packer Module in Difficult Conditions in Indonesia", SPE 54273, Apr. 1999, pp. 1-6.

* cited by examiner

FORMATION TESTING

BACKGROUND OF THE DISCLOSURE

The MDT (modular formation dynamics tester, trademark of Schlumberger Technology Corporation) is routinely run on TLC (tough logging conditions system, trademark of Schlumberger Technology Corporation) to perform mini DSTs (mini Drill Stem Tests).

U.S. Pat. No. 6,092,416 entitled "Downhole system and method for determining formation properties" describes a drill pipe or tubing attached to a sampling tool that is suspended in a borehole. A wireline cable also connects the tool to surface equipment and establishes electrical communication between the tool and the surface equipment. A valve located in the docking head assembly controls fluid flow between the borehole and the drill pipe through a port located within the drill pipe assembly which is opened and closed as required. During operations, the tool takes fluid samples from the formation and analyzes them for contamination levels. Unacceptable fluid is pumped or flowed through the tool via a flowline and into the drill pipe where it is stored until it is disposed of at the surface. Once the flowing fluid reaches acceptable levels of contamination, this fluid is pumped or flowed into one or more sample chambers in the tool. Once sampling is completed, the contaminated fluid is forced to the surface by opening the port and pumping a different fluid down the borehole annulus, through the port, and into the tool below the contaminated fluid, and thereby filling the drill pipe and forcing the contaminated fluid up the drill pipe and to the surface, instead of discarding the fluid into the borehole or storing the fluid in the tool. This system allows for larger amounts of fluid to be retrieved from the formation which results in cleaner fluid samples and better information about the formation. Moreover, the nature of the pressure data acquired both during periods of flow and shut-in can be used to deduce formation permeability and permeability anisotropy.

Patent Application Pub. No. WO2008/100156 entitled "Assembly and Method for Transient and Continuous Testing of an Open Portion of a Well Bore" discloses an assembly for transient and continuous testing of an open portion of a well bore. The assembly is arranged in a lower part of a drill string, and comprises: a minimum of two packers fixed at the outside of the drill string, the packers being expandable for isolating a reservoir interval; a down-hole pump for pumping formation fluid from the reservoir interval; a mud driven turbine or electric cable for supplying energy to the down-hole pump; a sample chamber; sensors and telemetry for measuring fluid properties; a closing valve for closing the fluid flow from the reservoir interval; and a circulation unit for mud circulation from a drill pipe to an annulus above the packers and feeding formation fluid from the down-hole pump to the annulus. The sensors and telemetry are for measuring and real-time transmission of the flow rate, pressure, and temperature of the fluid flow from the reservoir interval, from the down-hole pump, in the drill string, and in an annulus above the packers. The circulation unit can feed formation fluid from the reservoir interval into the annulus, so that a well at any time can be kept in over balance and so that the mud in the annulus at any time can solve the formation fluid from the reservoir interval.

The entire disclosures of U.S. Pat. No. 6,092,416 and Patent Application Pub. No. WO2008/100156 are incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
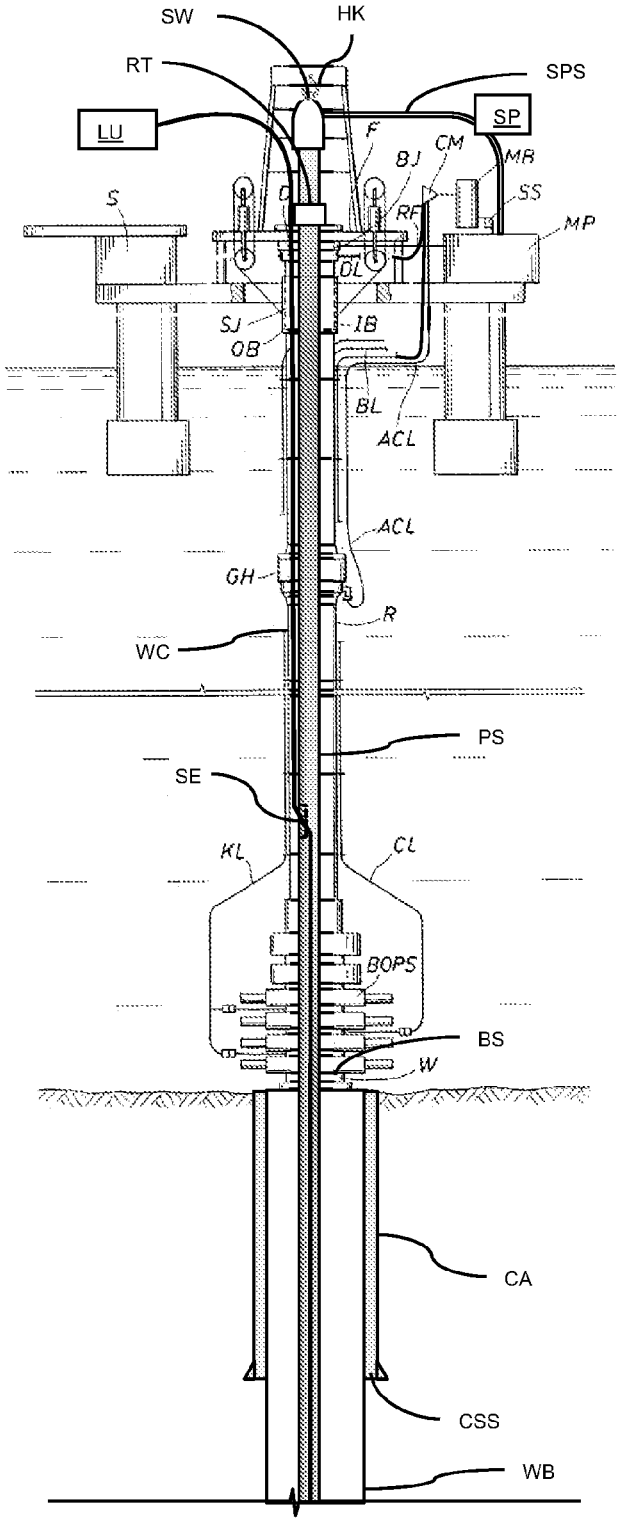
FIGS. 1A and 1B are schematic views of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to formation testing in an open hole environment. Formation testing is routinely performed to evaluate underground reservoirs. Formation testing typically includes a drawdown phase during which a pressure perturbation is generated in the reservoir by pumping formation fluid out of the reservoir, and a build-up phase during which pumping is stopped and the return of a sand-face pressure to equilibrium is monitored. Various reservoir parameters may be determined from the monitored pressure, such as formation fluid mobility in the reservoir and distances between the well being tested and flow barriers in the reservoir.

The present disclosure describes apparatus and methods that facilitate performing formation testing in open hole. The apparatus and methods described herein may alleviate well control while performing formation testing. For example, an apparatus according to one or more aspects of the present disclosure may comprise a formation testing assembly configured to permit a hydraulic bladder or packer of a blow-out-preventer or of a similar device to be closed around the formation testing assembly during formation testing, thereby sealing a well annulus. A method according to one or more aspects of the present disclosure may involve circulating drilling mud into a bore of the formation testing assembly down to a downhole circulation sub or unit and back up through the well annulus during at least a portion of a formation test. A formation fluid pumped from the reservoir may be mixed downhole with the circulated drilling mud according to suitable proportions. The mixture of pumped formation fluid and drilling mud may be circulated back to a surface separator via a choke line and/or a kill line towards a choke manifold. Wellbore sensors may be provided to interpret formation testing measurements more accurately.

FIG. 1A shows an offshore well site in which a formation tester system according to one or more aspects of the present disclosure may be used. The formation tester system can however be used onshore. The well site system is disposed above an open hole wellbore WB that is drilled through subsurface formations. However, part of the wellbore WB may be cased using a casing CA.

The well site system includes a floating structure or rig S maintained above a wellhead W. A riser R is fixedly connected to the wellhead W. A conventional slip or telescopic joint SJ, comprising an outer barrel OB affixed to the riser R and an inner barrel IB affixed to the rig S and having a pressure seal therebetween, is used to compensate for the relative vertical movement or heave between the rig S and the riser R. A ball joint BJ may be connected between the top inner barrel IB of the slip joint SJ and the rig S to compensate for other relative movement (horizontal and rotational) or pitch and roll of the rig S and the riser R.

Usually, the pressure induced in the wellbore WB below the sea floor is only that generated by the density of the drilling mud held in the riser R (hydrostatic pressure). The overflow of drilling mud held in the riser R may be controlled using a rigid flow line RF provided about the level of the rig floor F and below a bell-nipple. The rigid flow line RF may communicate with a drilling mud receiving device such as a shale shaker SS and/or a mud pit MP. If the drilling mud is open to atmospheric pressure at the rig floor F, the shale shaker SS and/or the mud pit MP may be located below the level of the rig floor F.

During some operations (such as when performing open hole formation testing), gas can unintentionally enter the riser R from the wellbore WB. One or more of a diverter D, a gas handler and annular blow-out preventer GH, and a blow-out preventer stack BOPS may be provided. The diverter D, the gas handler and annular blow-out preventer GH, and/or the blow-out preventer stack BOPS may be used to limit gas accumulations in the marine riser R and/or to prevent low pressure formation gas from venting to the rig floor F. The diverter D, the gas handler and annular blow-out preventer GH, and/or the blow-out preventer stack BOPS, may not be activated when a pipe string such as pipe string PS is manipulated (rotated, lowered and/or raised) in the riser R, and may only be activated when indications of gas in the riser R are observed and/or suspected.

The diverter D may be connected between the top inner barrel IB of the slip joint SJ and the rig S. When activated, the diverter D may be configured to seal around the pipe string PS using packers and to convey drilling mud and gas away from the rig floor F. For example, the diverter D may be connected to a flexible diverter line DL extending from the housing of the diverter D to communicate drilling mud from the riser R to a choke manifold CM. The drilling mud may then flow from the choke manifold CM to a mud-gas buster or separator MB and optionally to a flare line (not shown). The drilling mud may then be discharged to the shale shaker SS, mud pit MP, and/or other drilling mud receiving device(s).

The gas handler and annular blow-out preventer GH may be installed in the riser R below the riser slip joint SJ. The gas handler and annular blow-out preventer GH may be configured to provide a flow path for mud and gas away from the rig floor F, and/or to hold limited pressure on the riser R upon activation. For example, a hydraulic bladder may be used to provide a seal around the pipe string PS. An auxiliary choke line ACL may be used to circulate drilling mud and/or gas from the riser R via the gas handler annular blow-out preventer GH to the choke manifold CM on the rig S.

The blow-out preventer stack BOPS may be provided between a casing string CS or the wellhead W and the riser R. The blow-out preventer stack BOPS may be provided with one or more ram blow-out preventers. In addition, one or more annular blow-out preventers may be positioned in the blow-out preventer stack BOPS above the ram blow-out preventers. When activated, the blow-out preventer stack BOPS may provide a flow path for mud and/or gas away from the rig floor F, and/or to hold pressure on the wellbore WB. For example, the blow-out preventer stack BOPS may be in fluid communication with a choke line CL and a kill line KL connected between the desired ram blow-out preventers and/or annular blow-out preventers, as is known by those skilled in the art. The choke line CL may be configured to communicate with choke manifold CM. In addition to the choke line CL, the kill line KL and/or a booster line BL may be used to provide a flow path for mud and/or gas away from the rig floor F.

Figure 1B:
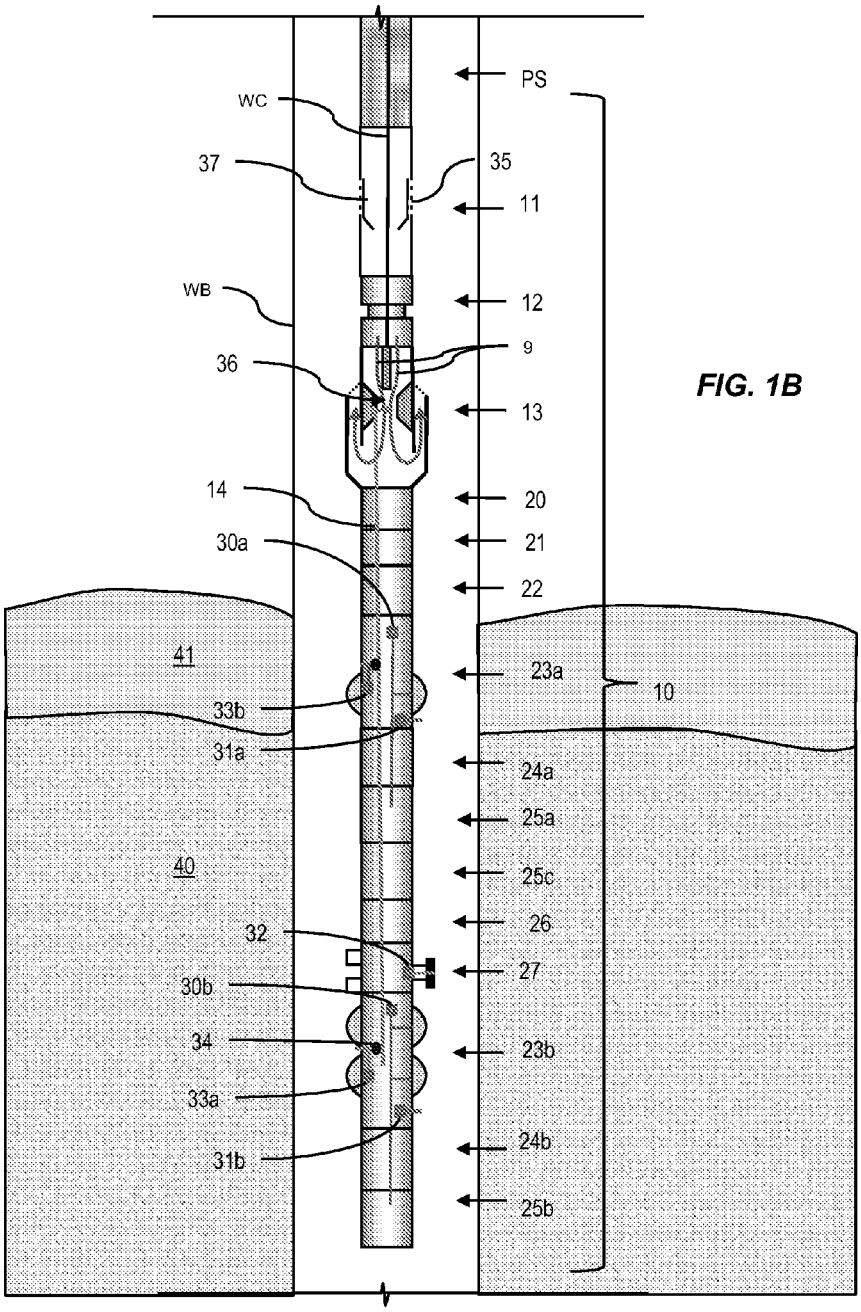

Referring collectively to FIGS. 1A and 1B, the well site system includes a derrick assembly positioned on the rig S. A drill string including a pipe string portion PS and a tool string portion at a lower end thereof (e.g., the tool string 10 in FIG. 1B) may be suspended in the wellbore WB from a hook HK of the derrick assembly. The hook HK may be attached to a traveling block (not shown), through a rotary swivel SW which permits rotation of the drill string relative to the hook. The drill string may be rotated by the rotary table RT, which is itself operated by well known means. For example, the rotary table RT may engage a kelly at the upper end of the drill string. As is well known, a top drive system (not shown) could alternatively be used instead of the kelly, rotary table RT and rotary swivel SW.

The surface system further includes drilling mud stored in a mud tank or mud pit MP formed at the well site. A surface pump SP delivers the drilling mud to an interior bore of the pipe string PS via a port in the swivel SW, causing the drilling mud to flow downwardly through the pipe string PS. The drilling mud may alternatively be delivered to an interior bore of the pipe string PS via a port in a top drive (not shown). The drilling mud may exit the pipe string PS via a fluid communicator configured to allow fluid communication with an annulus between the tool string and the wellbore wall, as indicated by arrows 9. The fluid communicator may comprise a jet pump. The jet pump may comprise an auxiliary outlet (not shown) configured to route a portion of the drilling mud towards a cooling loop associated with one or more heat-generating elements in the tool string. For example, the drilling mud may be routed through a flow path or passage and past or adjacent a heat exchanger to which the heat-generating component is coupled and thereafter discharged into the wellbore or wellbore. The jet pump may also be configured to mix the drilling mud with a formation fluid pumped from the formation, as further explained below. The drilling mud and/or the mixture of drilling mud and pumped formation fluid may then circulate upwardly through the annulus region between the outside of the drill string and the wall of the wellbore WB, whereupon the drilling mud and/or the mixture of drilling mud and pumped formation fluid may be diverted to one or more of the choke line CL, the kill line KL, and/or the booster line BL, among other return lines. A liquid portion of drilling mud and/or the mixture of drilling mud and pumped formation fluid may then be returned to the mud pit MP via the choke manifold CM and the mud-gas buster or separator MB. A gas portion may be flared, vented or disposed of at the rig S.

The surface system further includes a logging unit LU. The logging unit LU typically includes capabilities for acquiring, processing, and storing information, as well as for communicating with the tool string 10 and/or other sensors, such as a stand pipe pressure and/or temperature sensor SPS, a blow-out-preventer stack pressure and/or temperature sensor BS, and/or a casing shoe pressure and/or temperature sensor CSS.

The logging unit LU may include a controller having an interface configured to receive commands from a surface operator. The controller in logging unit LU may be further configured to control the pumping rate of the surface pump SP.

In the shown example, the logging unit LU is communicatively coupled to an electrical wireline cable WC. The wireline cable WC is configured to transmit data between the logging unit and one or more components of the tool string (e.g., the tool string 10 in FIG. 1B). For example, one segment of the pipe string may include a side entry sub SE. The side entry sub SE may comprise a tubular device with a cylindrical shape and having an opening on one side. The side opening may allow the wireline cable WC to enter/exit an internal bore of the pipe string PS, thereby permitting the pipe string segments to be added or removed without having to disconnect (unlatch and latch) the wireline cable WC from surface equipment. Thus, the side entry sub SE may provide a quick and easy means to run a tool string (e.g., the tool string 10 of FIG. 1B) to a suitable depth at which formation testing may be performed without having to unlatch the wireline from the tool. While a wireline cable WC is shown in FIG. 1A to provide data communication, other means for providing data communication between the components of the tool string 10 and the logging unit LU either ways (i.e., uplinks and/or downlinks) may be used, including Wired Drill Pipe (WDP), acoustic telemetry, and/or electromagnetic telemetry.

In the shown example, the wireline cable WC is further configured to send electrical power to one or more components of the tool string 10. However, other means for providing electrical power to the components of the tool string may be used, including a mud driven turbine housed at the end of the pipe string PS.

FIG. 1B is a schematic view of the tool string 10 configured for conveyance in the wellbore WB extending into the subterranean formation. The tool string 10 is suspended at the lower end of the pipe string PS. The tool string 10 may be of modular type. For example, the tool string 10 may include one or more of a cross-over sub 11, a slip joint 12, and a diverter sub 13 fluidly connected to the interior bore in the pipe string PS. The tool string 10 may also include a tension-compression sub 20, a telemetry cartridge 21, a power cartridge 22, a plurality of packer modules 23*a* and 23*b*, a plurality of pump modules 24*a* and 24*b*, a plurality of sample chamber modules 25*a*, 25*b*, and 25*c*, a fluid analyzer module 26, and a probe module 27. For example, these later modules or cartridges may be implemented using downhole tools similar to those used in wireline operations.

The cross-over sub 11 (optional) may include a hollow mandrel having a cross-over port 35 and an annular sleeve 37 carried within the hollow mandrel and reciprocable between a normally closed position and an open position in which the sleeve uncovers the cross-over port in the mandrel. In operation, the wireline cable may be removed and a ball (not shown) may be dropped and seated on the annular sleeve 37. As internal pressure in the pipe string is thereafter increased, the annular sleeve 37 may shift downwardly and uncover the cross-over port 35 in the mandrel which permits the flow of proppants or other completion fluid into the wellbore. The proppants may be used to seal formation fractures that may have been inadvertently generated during formation testing.

The slip joint 12 may be configured to permit relative translation between an upper portion of the tool string (i.e., the portion above the slip joint 12 in FIG. 1B) attached to the pipe string, and a lower portion of the tool string (i.e., the portion below the slip joint 12 in FIG. 1B), for example including one or more inflatable packers (e.g., disposed on packer modules 23*a* and/or 23*b*) configured to selectively engage the wall of the wellbore WB. For example, the slip-joint 12 may have an adjustable length of 5 feet between collapsed and expanded positions. The slip joint 12 may be pressure compensated. Thus, the slip joint 12 would not induce compression and/or tension forces in the tool string when drilling mud is circulated therethrough.

As previously discussed, the diverter sub 13 comprises a fluid communicator, such as provided with a jet pump, configured to allow fluid communication with an annulus between the tool string and the wellbore wall. The jet pump includes a flow area restriction 36 disposed in the path 9 of the drilling mud towards in an interior bore of the diverter sub 13. Upon circulation of the drilling mud, the flow area restriction 36 generates a high pressure zone (e.g., above the restriction as shown in FIG. 1B) and a low pressure zone (e.g., at the restriction as shown in FIG. 1B). The diverter sub is also fluidly coupled to a main flow line 14 in which pumped formation fluid may flow. The main flow line 14 may terminate at an exit port located in the low pressure zone of the jet pump. In operations, drilling mud and formation fluid may contemporarily be pumped in the jet pump. As the exit port of the main flow line is located in the low pressure zone of the jet pump, the output pressure of the main flow line may be lower than the hydrostatic or hydrodynamic pressure of the drilling mud in the annulus between the tool string and the wall of the wellbore WB. Thus, the amount of power used for pumping formation fluid through the main flow line and into the wellbore may be reduced, or conversely, the rate at which formation fluid may be pumped through the main flow line and into the wellbore using a given amount of power may be increased. Further, as the drilling mud velocity is higher in the low pressure zone, discharging pumped formation fluid in the low pressure zone may facilitate the mixing or dilution of pumped formation fluid into the circulated drilling mud.

While a flow area restriction is disposed in an interior bore of the diverter sub in the example shown in FIG. 1B, the flow area restriction may alternatively be disposed in the annulus between the flow diverter sub and the wall of the wellbore WB (not shown). For example, drilling fluid may be discharged to the annulus via a first fluid communicator with the annulus between the tool string and the wellbore wall. Helical protuberances (not shown) extending in at least a portion of the annulus and not disposed deeper in the wellbore than the first communicator may be used to restrict the upward flow of drilling mud in the annulus. The formation fluid may be pumped to a second fluid communicator to the annulus that is located between the helical protuberances defining the flow restriction. The second fluid communicator may be disposed not deeper in the wellbore than the first communicator therefore facilitating the mixing or dilution of pumped formation fluid into the circulated drilling mud, among other possible advantages.

The tension-compression sub 20 may be configured to measure the magnitude and direction of the axial force applied by the pipe string to the tool string. For example, the tension-compression sub may comprise or be implemented using a force sensor such as described in U.S. Pat. No. 6,799,469, the entire disclosure of which is incorporated herein by reference.

The telemetry cartridge 21 and power cartridge 22 may be electrically coupled to the wireline cable WC via a logging head connected to the tool string below the slip joint (not shown). The telemetry cartridge 21 may be configured to receive and/or send data communication to the wireline cable WC. The telemetry cartridge 21 may comprise a downhole controller (not shown) communicatively coupled to the wireline cable WC. For example, the downhole controller may be configured to control the inflation/deflation of packers (e.g., packers disposed on packer modules 23*a* and/or 23*b*), the opening/closure of valves to route fluid flowing in the main flow line in the tool string and/or the pumping of formation fluid, for example by adjusting the pumping rate of a sampling device disposed in the tool string, such as the pump module 24*b*. The downhole controller may further be configured to analyze and/or process data obtained, for example, from various sensors in disposed in the tool string (e.g., pressure/temperature gauges 30*a*, 30*b*, 31*a*, 31*b*, 32*a*, 32*b* and/or 33, and/or fluid analysis sensors disposed in the fluid analyzer module 26), and/or to communicate measurement or processed data to the surface for subsequent analysis. The power cartridge 22 may be configured to receive electrical power from the wireline cable WC and supply suitable voltages to the electronic components in the tool string.

One or more of the pump modules (e.g., 24*a*) may be configured to pump fluid from the formation via a fluid communicator to the wellbore and into the main flow line 14 through which the obtained fluid may flow and be selectively routed to sample chambers in sample chamber modules (e.g., 25*c*) and/or to fluid analyzer modules (e.g. 26), and/or may be discharged in the wellbore as discussed above. Example implementations of the pump module may be found in U.S. Pat. No. 4,860,581 and/or U.S. Patent Application Pub. No. 2009/0044951, the entire disclosures of which are incorporated herein by reference. Additionally, one or more of the pump modules (e.g., 24*a* and/or 24*b*) may be configured to pump an inflation fluid conveyed in a sample chamber module (e.g., 25*a*, 25*b*) in and/or out of inflatable packers disposed on packers modules (e.g., 23*a* and/or 23*b*) in the tool string 10.

The fluid analyzer module 26 may be configured to measure properties or parameters of the fluid extracted from the formation. For example, the fluid analyzer module 26 may include a fluorescence spectroscopy sensor (not shown), such as described in U.S. Pat. No. 7,705,982, the entire disclosure of which is incorporated herein by reference. Further, the fluid analyzer module 26 may include an optical fluid analyzer (not shown), for example as described in U.S. Pat. No. 7,379,180, the entire disclosure of which is incorporated herein by reference. Still further, the fluid analyzer module 26 may comprise a density/viscosity sensor (not shown), for example as described in U.S. Patent Application Pub. No. 2008/0257036, the entire disclosure of which is incorporated herein by reference. Yet still further, the fluid analyzer module may include a resistivity cell (not shown), for example as described in U.S. Pat. No. 7,183,778, the entire disclosure of which is incorporated herein by reference. An implementation example of sensors in the fluid analyzer module may be found in a "New Downhole-Fluid Analysis-Tool for Improved Reservoir Characterization" by C. Dong et al. SPE 108566, December 2008. It should be appreciated however that the fluid analyzer module 26 may include any combination of conventional and/or future-developed sensors within the scope of the present disclosure. The fluid analyzer module 26 may be used to monitor one or more properties or parameters of the fluid pumped through the main flow line 14. For example, the density, viscosity, gas-oil-ratio (GOR), gas content (e.g., methane content C1, ethane content C2, propane-butane-pentane content C3-C5, carbon dioxide content CO2), and/or water content (H2O) may be monitored.

The packer modules 23*a* and/or 23*b* may be of a type similar to the one described in "The Application of Modular Formation Dynamics Tester—MDT* with a Dual Packer Module in Difficult Conditions in Indonesia" by Siswantoro M P, T. B. Indra, and I. A. Prasetyo, SPE 54273, April 1999. The packer modules 23*a* and/or 23*b* may include a wellbore pressure and/or temperature gauge (e.g., 31*a*, 31*b*) configured to measure the pressure/temperature in the wellbore annulus. The packer modules 23*a* and/or 23*b* may also include an inflation pressure gauge (e.g., 30*a*, 30*b*) configured to measure the pressure in the packers. The packer modules 23*a* and/or 23*b* may include an inlet pressure and/or temperature gauge (e.g., 33*a*, 33*b*) configured to monitor the pressure/temperature of fluid pumped in the main flow line 14, of fluid inside two packers defining a packer interval, and/or of fluid above or below a packer. The pressure and/or temperature gauge may be implemented similarly to the gauges described in U.S. Pat. Nos. 4,547,691, and 5,394,345 (the entire disclosures of which are incorporated herein by reference), strain gauges, and combinations thereof. The packer modules 23*a* and/or 23*b* may include a by-pass flow line (not shown) for establishing a wellbore fluid communication across the packer interval. In operations, the packer modules 23*a* and/or 23*b* may be used to isolate a portion of the annulus between the tool string 10 and the wall of the wellbore WB. The packer modules 23*b* may also be used to extract fluid from the formation via an inlet. A fluid communicator (e.g., including the isolation valve 34) disposed in the packer module 23*b* may be configured to selectively prevent fluid communication between the main flow line 14 (and thus the tool string 10) and the wellbore annulus. While the packer modules 23*a* and/or 23*b* are shown provided with two or less inflatable packers in FIG. 1B, the packer modules 23*a* and/or 23*b* may alternatively be provided with two or more packers, for example as illustrated in U.S. Patent Application Publication No. 2010/0050762, filed on Sep. 2, 2008, the entire disclosure of which is incorporated herein by reference. In these cases, multiple packers may be used to mechanically stabilize a sealed-off section of the wellbore (e.g., an inner interval) in which pressure testing and/or fluid sampling operations may be performed. Thus, build-up pressure measured in the stabilized sealed-off section may be less affected by transient changes of wellbore pressure around the multiple packer system.

The probe module 27 may include extendable setting pistons and an extendable sealing probe configured to selectively establish a fluid communication with the formation beyond the wall of the wellbore WB. The probe module 27 may also include a drawdown piston (not shown) to lower the pressure in the fluid communication with the formation below formation pressure. The probe module may also comprise a pressure and/or temperature gauge 32, which may, for example, similar to the pressure/temperature gauges 33*a* and/or 33*b*. When the probe of the probe module 27 is extended into sealing engagement with the formation, the pressure and/or temperature gauge 32 may be used to measure the pressure disturbances in the formation caused by pumping fluid from the formation between the packers of the packer module 23*b* (i.e., to perform a vertical interference test VIT). When the probe of the probe module 27 is retracted from the wall of the wellbore WB, the pressure and/or temperature gauge 32 may be used to measure the pressure and/or temperature in the wellbore annulus.

The sample chamber modules 25*a*, 25*b*, and 25*c* may each comprise one or more sample chambers. For example, the sample chamber modules 25*a* and 25*b* may each comprise a large sample chamber configured to convey an inflation fluid (such as water) into the wellbore. The inflation fluid may be used to inflate the packers of the packer modules 23*a* and 23*b* using, for example, the pump modules 24*a* and 24*b*, respectively, to force water into the inflatable packers. The sample chamber module 25*c* may comprise a plurality of sample chambers configured to retain one or more samples of formation fluid pumped from the formation. For example, the sample chamber module 25*c* may be implemented similarly to the description of the sample chamber module described in U.S. Pat. No. 7,367,394, the entire disclosure of which is incorporated herein by reference.

Figure 2:
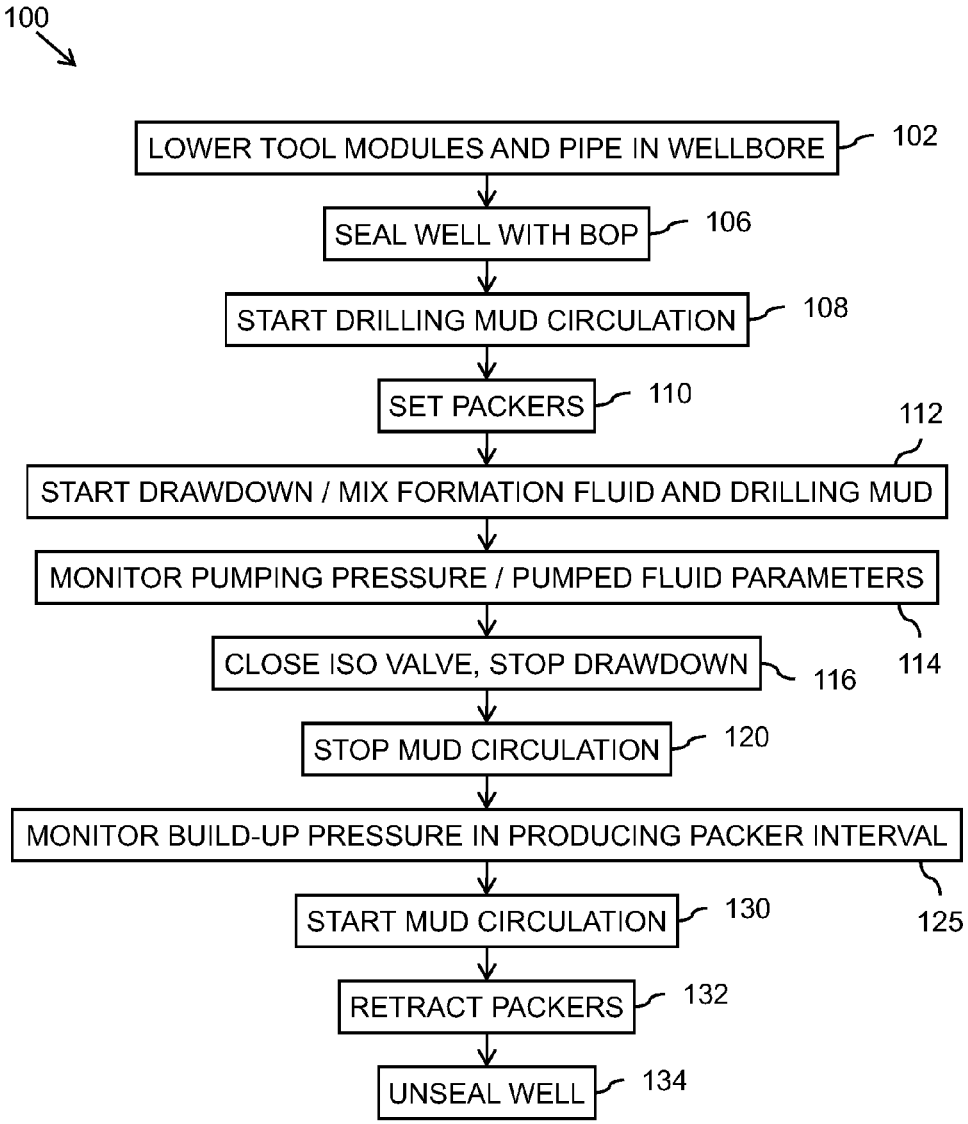
FIG. 2 is a flow-chart diagram of at least a portion of a method according to one or more aspects of the present disclosure.

FIG. 2 is a flow-chart diagram of at least a portion of a method 100 of performing formation testing according to one or more aspects of the present disclosure. The method 100 may be performed using, for example, the well site system of FIG. 1A and/or the tool string 10 of FIG. 1B. The method 100 may permit mixing fluid pumped from the formation and circulated drilling mud during at least a portion of a formation test, thereby alleviating well control while performing formation testing. It should be appreciated that the order of execution of the steps depicted in FIG. 2 may be changed and/or some of the steps described may be combined, divided, rearranged, omitted, eliminated and/or implemented in other ways.

At step 102, modules of a tool string (e.g., the modules of the tool string 10 of FIG. 1B) and segments of a pipe string (e.g., segments of the pipe string PS of FIGS. 1A and/or 1B) are assembled to form a drill string configured to be lowered at least partially into a wellbore. The tool string and the pipe string segments may be assembled such that the tool string is almost adjacent to the formation to be tested (e.g., the formation 40 in FIG. 1B).

At step 106, the pipe string position is maintained. A hydraulic bladder, such as a hydraulic bladder provided with the blow-out preventer BOPS in FIG. 1A, is extended into sealing engagement against the pipe string to seal a well annulus. As mentioned before, other sealing devices may be used to seal a well annulus at step 106.

At step 108, circulation of drilling mud in the well is initiated. For example, the drilling mud may be pumped from a mud pit (e.g., the mud pit MP in FIG. 1A) down into a bore of the formation testing assembly using a surface pump (e.g., the surface pump SP in FIG. 1A). The drilling mud may be introduced into the pipe string through a port in a rotary swivel (e.g., the rotary swivel SW in FIG. 1A) or through a port in a top drive. The drilling mud may then flow down in the pipe string to a downhole circulation sub (e.g., the diverter sub 13 of FIG. 1B) and back up through the well annulus. The drilling mud may then be routed to one or more return lines (e.g., the choke line CL, the kill line KL, and/or the booster line BL in FIG. 1A) towards a choke manifold (e.g., the choke manifold CM in FIG. 1A) and a mud-gas buster or separator (e.g., the mud-gas buster MB), thereby reducing the risk of the venting downhole gases on the rig floor (e.g., the rig floor F in FIG. 1A).

At step 110, packers of the tool string (such as packers provided with the packer modules 23*a* and/or 23*b* of the tool string 10 in FIG. 1B) may be set. For example, a downhole pump (e.g., the downhole pump 24*b* in FIG. 1B) may be used to inflate the packers of a packer module (e.g., the packer module 23*b* in FIG. 1B) with an inflation fluid conveyed in a sample chamber module (e.g., the sample chamber module 25*b* in FIG. 1B). Thus, the packers may establish a fluid communication with the formation to be tested (e.g., the formation 40 in FIG. 1B). In addition, other packers may also be inflated to isolate a portion of the wellbore from pressure fluctuations caused by the circulation of drilling mud. For example, a downhole pump (e.g., the downhole pump 24*a* in FIG. 1B) may be used to inflate the packers of another packer module (e.g., the packer module 23*a* in FIG. 1B) with an inflation fluid conveyed in a sample chamber module (e.g., the sample chamber module 25*a* in FIG. 1B). As shown in FIG. 1B, the packer module 23*a* is positioned sufficiently spaced apart from the packer module 23*b* and/or sufficiently close to the diverter sub 13 so that the formation to be tested 40 is less affected by drilling mud circulation above the packer module 23*a*. In some cases, the packer module 23*a* may be set against another formation (e.g., formation 41 in FIG. 1B) which is known or suspected to be hydraulically isolated from the formation 40.

At step 112, the downhole tool string (e.g., the pump module 24*a* of the downhole tool string 10 in FIG. 1B) is operated to pump fluid from the formation (e.g., the formation 40) through the interval defined by a packer module (e.g., the packer module 23*b* in FIG. 1B) and into a flow line of the downhole tool string (e.g., the main flow line 14 in FIG. 1B). The fluid pumped from the formation may be mixed with circulated drilling fluid. For example, the formation fluid may be mixed in appropriate proportions with drilling mud at the circulation sub (e.g., the diverter sub 13 in FIG. 1B). Thus, the formation fluid may be carried away in the drilling mud towards a mud-gas buster (e.g., the mud-gas buster MB in FIG. 1A), thereby alleviating well control while performing formation testing.

At step 114, a pressure of the fluid pumped from the formation is monitored, for example using the pressure and/or temperature gauge 33*a* in FIG. 1A. In addition, a parameter of the fluid pumped is also monitored, for example using a sensor provided with the fluid analyzer module 26 in FIG. 1B. The pumped fluid parameter may be one or more of a viscosity, a density, an optical property, a gas-oil-ratio (GOR), a gas content (e.g., methane content C1, ethane content C2, propane-butane-pentane content C3-C5, carbon dioxide content CO2), and/or a water content (H2O), among other parameters. A pumped fluid viscosity value may be stored and used subsequently to determine a formation permeability from the formation fluid mobility.

At step 116, an isolation valve (e.g., the isolation valve 34 in FIG. 1B) may be closed to isolate the producing interval between the packers (e.g., the packers of the packer module 23*b*) from the tool string. The isolation valve may be closed once sufficient fluid has been pumped from the formation to be tested and halt pumping from the formation to be tested. Then, the downhole tool string may be operated to halt pumping (e.g., halt pumping by the pump module 24*a* of the downhole tool string 10 in FIG. 1B).

At step 120, the circulation of drilling mud may be stopped or halted. This optional step may be performed, for example, when the circulation of drilling fluid may affect the confidence of the interpretation of build-up pressure monitored at step 125. For example, circulation of drilling fluid may induce flow of drilling mud filtrate through a mud-cake lining the wall of the wellbore penetrating the formation to be tested. The flow of drilling mud filtrate may in turn generate pressure disturbances measurable in the packer interval isolated at step 116. These pressure disturbances may negatively affect the interpretation of the pressure measurement data collected at step 125.

At step 125, build-up pressure monitoring in the producing interval isolated at step 116 is initiated. For example, the pressure and/or temperature gauge 33*a* in FIG. 1A may be used, as the pressure and/or temperature gauge 33*a* is still in pressure communication with the producing interval when the isolation valve 34 is closed. Monitoring may continue for several hours, depending for example on how fast the pressure in the formation to be tested returns to equilibrium.

At step 130, the circulation of drilling fluid may be restarted, for example when the monitoring of build-up pressure in the producing packer interval initiated at step 125 is deemed sufficient. This step may be performed when fluid pumped from the formation and mixed with the drilling mud is still present in the well. By circulating this mixture towards a mud-gas buster or separator (e.g., the mud-gas buster MB in FIG. 1A), gas that may be present in the well may be essentially vented away from the rig floor before unsealing the well.

At step 132, the packers set at step 110 may be retracted or deflated.

At step 134, the hydraulic bladder used to seal the well annulus at step 106, such as a hydraulic bladder provided with the blow-out preventer BOPS in FIG. 1A, may be retracted. Thus, the well annulus may be unsealed and the tool string may be free to move in the well. The tool string may be positioned in the wellbore for a formation test at another location in the same well. For example, a portion of the steps shown in FIG. 2 may be repeated.

In view of all of the above and FIGS. 1A, 1B, and 2, it should be readily apparent to those skilled in the art that the present disclosure provides an apparatus, comprising a downhole tool configured for conveyance in a wellbore extending into a subterranean formation, wherein the downhole tool comprises a first fluid communicator configured to allow drilling fluid communication with an annulus between the downhole tool and the wellbore, a second fluid communicator configured to direct formation fluid to the annulus, and a formation testing device disposed deeper in the wellbore relative to the first fluid communicator and configured to pump formation fluid from the formation to the second fluid communicator. At least one of the first and second fluid communicators comprises a jet pump. The formation testing device may comprise first and second inflatable packers each configured to engage the wellbore proximate the formation, and a third fluid communicator positioned between the first and second packers. The third fluid communicator may be further configured to selectively prevent fluid communication between the downhole tool and the annulus. The downhole tool may further comprise a third inflatable packer configured to engage the wellbore, wherein the first and second packers are positioned below the third packer. The third packer may be positioned adjacent to at least one of the first and second fluid communicators. The downhole tool may be configured for conveyance in the wellbore via a drill string, and the downhole tool may further comprise a slip joint having an adjustable length. The downhole tool may further comprise a sensor configured to sense a gas-to-oil ratio of the formation fluid pumped from the formation. The downhole tool may further comprise a sensor configured to sense a density of the formation fluid pumped from the formation. The downhole tool may further comprise a sensor configured to sense a viscosity of the formation fluid pumped from the formation. The downhole tool may further comprise a normally closed cross-over port. The downhole tool may be configured to receive electrical power from at least one of a mud driven turbine housed in the downhole tool, and an electrical cable extending within the wellbore. The downhole tool may be configured to receive data communication from at least one of an electrical cable extending within the wellbore, wired drill pipe conveying the downhole tool in the wellbore, acoustic telemetry, and electromagnetic telemetry. The downhole tool may further comprise a controller configured to control a pumping rate of the formation testing device. The first fluid communicator may comprise a jet pump. The jet pump comprises an auxiliary outlet configured to route drilling fluid towards a cooling loop associated with a heat-generating component of the downhole tool. The second fluid communicator may comprise a jet pump. The jet pump may be configured to reduce an output pressure of the formation testing device. The jet pump may be configured to mix the drilling fluid with the pumped formation fluid. The second fluid communicator may not be disposed deeper in the wellbore than the first fluid communicator.

The present disclosure also provides an apparatus, comprising a downhole tool configured for conveyance in a wellbore extending into a subterranean formation, wherein the downhole tool comprises a fluid communicator configured to communicate the pumped formation fluid and drilling fluid to an annulus between the downhole tool and the wellbore, and a formation testing device disposed deeper in the wellbore relative to the fluid communicator and configured to pump formation fluid from the formation to the fluid communicator. The fluid communicator comprises a jet pump. The fluid communicator may be a first fluid communicator, and the formation testing device may further comprise first and second inflatable packers each configured to engage the wellbore proximate the formation, and a second fluid communicator positioned between the first and second packers. The second fluid communicator may be further configured to selectively prevent fluid communication between the downhole tool and the annulus. The downhole tool may further comprise a third inflatable packer configured to engage the wellbore, wherein the first and second packers are positioned below the third packer. The third packer may be positioned adjacent to the fluid communicator. The downhole tool may be configured for conveyance in the wellbore via a drill string, and the apparatus may further comprise a slip joint having an adjustable length. The downhole tool may further comprise a sensor configured to sense a gas-to-oil ratio of the formation fluid pumped from the formation. The downhole tool may further comprise a sensor configured to sense a density of the formation fluid pumped from the formation. The downhole tool may further comprise a sensor configured to sense a viscosity of the formation fluid pumped from the formation. The downhole tool may be configured to receive electrical power from at least one of a mud driven turbine housed in the downhole tool, and an electrical cable extending within the wellbore. The downhole tool may be configured to receive data communication from at least one of an electrical cable extending within the wellbore, wired drill pipe conveying the downhole tool in the wellbore, acoustic telemetry, and electromagnetic telemetry. The downhole tool may further comprise a controller configured to control a pumping rate of the formation testing device. The jet pump may comprise an auxiliary outlet configured to route drilling fluid towards a cooling loop associated with a heat-generating component of the downhole tool. The jet pump may be configured to reduce an output pressure of the sampling device. The jet pump may be configured to mix the drilling fluid with the pumped formation fluid.

The present disclosure also provides a method, comprising conveying a downhole tool in a wellbore extending into a subterranean formation, wherein the downhole tool comprises a first fluid communicator configured to allow drilling fluid communication with an annulus between the downhole tool and the wellbore, a second fluid communicator configured to direct formation fluid to the annulus; and a formation testing device disposed deeper in the wellbore relative to the first fluid communicator and configured to pump formation fluid from the formation to the second fluid communicator, wherein at least one of the first and second fluid communicators comprises a jet pump. The method also comprises pumping formation fluid with the formation testing device, and mixing drilling fluid and the pumped formation fluid with the jet pump.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance in a wellbore extending into a subterranean formation, wherein the downhole tool comprises:

a jet pump configured to communicate pumped formation fluid and drilling fluid to an annulus between the downhole tool and the wellbore; and a pump module disposed deeper in the wellbore relative to the jet pump and configured to pump formation fluid from the formation to the jet pump.

2. The apparatus of claim 1 comprising:

first and second inflatable packers each configured to engage the wellbore proximate the formation; and an isolation valve positioned between the first and second packers, wherein the isolation valve is configured to selectively prevent fluid communication between the downhole tool and the annulus.

3. The apparatus of claim 2 wherein the downhole tool further comprises a third inflatable packer configured to engage the wellbore, wherein the first and second packers are positioned below the third packer.

4. The apparatus of claim 3 wherein the third inflatable packer is positioned adjacent to the jet pump.

5. The apparatus of claim 1 wherein the downhole tool is configured for conveyance in the wellbore via a drill string, and wherein the apparatus further comprises a slip joint having an adjustable length.

6. The apparatus of claim 1 wherein the downhole tool further comprises a sensor configured to sense a gas-to-oil ratio of the formation fluid pumped from the formation.

7. The apparatus of claim 1 wherein the downhole tool further comprises a sensor configured to sense a density of the formation fluid pumped from the formation.

8. The apparatus of claim 1 wherein the downhole tool further comprises a sensor configured to sense a viscosity of the formation fluid pumped from the formation.

9. The apparatus of claim 1 wherein the downhole tool is configured to receive data communication from at least one of an electrical cable extending within the wellbore, wired drill pipe conveying the downhole tool in the wellbore, acoustic telemetry, or electromagnetic telemetry.

10. The apparatus of claim 1 wherein the downhole tool further comprises a controller configured to control a pumping rate of the pump module.

11. The apparatus of claim 1 wherein the jet pump is configured to reduce an output pressure of the pump module.

12. The apparatus of claim 1 wherein the jet pump is configured to mix the drilling fluid with the pumped formation fluid.

13. The apparatus of claim 1 wherein the downhole tool further comprises a normally closed cross-over port.

14. The apparatus of claim 1 wherein:

the jet pump comprises a first jet pump configured to direct drilling fluid to the annulus and a second jet pump configured to direct formation fluid to the annulus;

the pump module is disposed deeper in the wellbore relative to the first jet pump and is configured to pump formation fluid from the formation to the second jet pump.

15. The apparatus of claim 14 comprising:

first and second inflatable packers each configured to engage the wellbore proximate the formation; and an isolation valve positioned between the first and second packers, wherein the isolation valve is further configured to selectively prevent fluid communication between the downhole tool and the annulus.

16. The apparatus of claim 15 wherein the downhole tool further comprises a third inflatable packer configured to engage the wellbore, wherein the first and second packers are positioned below the third packer.

17. The apparatus of claim 16 wherein the third packer is positioned adjacent to at least one of the first and second jet pumps.

18. The apparatus of claim 14 wherein the second jet pump is not disposed deeper in the wellbore than the first jet pump.

19. A method, comprising:

conveying a downhole tool in a wellbore extending into a subterranean formation, wherein the downhole tool comprises:

a first jet pump configured to allow drilling fluid communication with an annulus between the downhole tool and the wellbore;

a second jet pump configured to direct formation fluid to the annulus; and a pump module disposed deeper in the wellbore relative to the first jet pump and configured to pump formation fluid from the formation to the second jet pump;

pumping formation fluid with the pump module; and mixing drilling fluid and the pumped formation fluid with at least one of the first jet pump, the second jet pump, or both.

* * * * *